United States Patent [19]

Alexandersson

[11] 4,406,412

[45] Sep. 27, 1983

[54] JAW CRUSHER FOR BULKY WASTE AND LIKE MATTER

[75] Inventor: Sven A. Alexandersson, Risskov, Denmark

[73] Assignee: Bruun & Sorensen A/S, Arhus, Denmark

[21] Appl. No.: 317,313

[22] Filed: Nov. 2, 1981

[30] Foreign Application Priority Data

Nov. 13, 1980 [SE] Sweden ..... 8007985

[51] Int. Cl.[3] ..... B02C 1/06

[52] U.S. Cl. ..... 241/36; 241/37; 241/266

[58] Field of Search ..... 241/262–269, 241/33, 36, 37

[56] References Cited

U.S. PATENT DOCUMENTS

| | | | |
|---|---|---|---|
| 3,223,334 | 12/1965 | Wuthrich | 241/36 |
| 3,861,604 | 1/1975 | Nobelius | 241/269 |
| 4,275,852 | 6/1981 | Asplund | 241/37 X |
| 4,294,413 | 10/1981 | Cerroni | 241/36 |

FOREIGN PATENT DOCUMENTS

| | | | |
|---|---|---|---|
| 2011975 | 9/1971 | Fed. Rep. of Germany | 241/266 |

*Primary Examiner*—Mark Rosenbaum
*Attorney, Agent, or Firm*—Holman & Stern

[57] ABSTRACT

A jaw crusher for bulky waste and like matter, comprising two groups of jaws or shanks movable towards and away from each other, the jaws or shanks within each group being spaced at an interval corresponding to the width of the jaws or shanks of the opposite group. The jaws or shanks of one group are adapted, as they move towards the other group, to travel at least partly into the interspaces between the jaws or shanks of the opposite group, and include driving units actuating at least one group of jaws or shanks in order to move them towards the opposite group. At least one of the jaws included in at least one group of jaws is movable relative to the remaining jaws of the same group, the jaws are individually movable by individually actuable driving units, and the driving units are provided with sensors for sensing exerted power and actuating a programmable central unit which controls the relative position of the jaws so that it will vary during the cutting-up operation.

6 Claims, 3 Drawing Figures

JAW CRUSHER FOR BULKY WASTE AND LIKE MATTER

BACKGROUND OF THE INVENTION

1. Field of the Invention

The present invention relates to a jaw crusher for bulky waste and like matter, including two groups of jaws or shanks being movable towards and away from each other, the jaws or shanks within each group being placed at an interval corresponding to the width of the jaws or shanks of the opposite group, the jaws or shanks of one group being adapted, as they move towards the other group, to travel at least partly into the interspace between the jaws or shanks of the opposite group, and including driving units actuating at least one group of jaws or shanks in order to move them towards the opposite group.

2. Description of the Prior Art

In prior-art crushing devices for the aforementioned purpose the disintegration of the material to be cut takes place primarily by cutting or shearing action, said material being sheared off over sharp edge means provided on the edges of the jaws or shanks. It has been found that the disintegration of heavy material, such a wooden or metal beams, metal objects and building waste, requires very great forces and that prior-art type jaw crushers must therefore be highly overdimensioned as far as driving power is concerned.

BRIEF SUMMARY OF THE INVENTION

The object of this invention is to provide an apparatus making it possible to disintegrate at a moderate power demand also such material as is regarded as difficult.

The essential characteristic of a jaw crusher according to the invention is that at least one of the jaws included in at least one group of jaws is movable relative to the remaining jaws of the same group, that the jaws are individually movable by individually actuable driving units, and that said driving units are provided with means sensing exerted power and actuating a preprogrammable central unit which controls the relative position of the jaws so that it will vary during the cutting-up operation.

Essential to the function of the jaw crusher is that the jaws do not, as do prior-art crushers, move towards each other in laterally aligned relationship, i.e. in common planes, but that the relative position of the jaws varies throughout the cutting operation so that the material to be cut is subjected to repeated breaking and bending stresses in various directions at the same time as the sharp edges means provided in the jaws cut up the material.

BRIEF DESCRIPTION OF THE DRAWINGS

The invention will be described in more detail hereinafter with reference to the accompanying drawings, in which.

DETAILED DESCRIPTION

Figure 1:
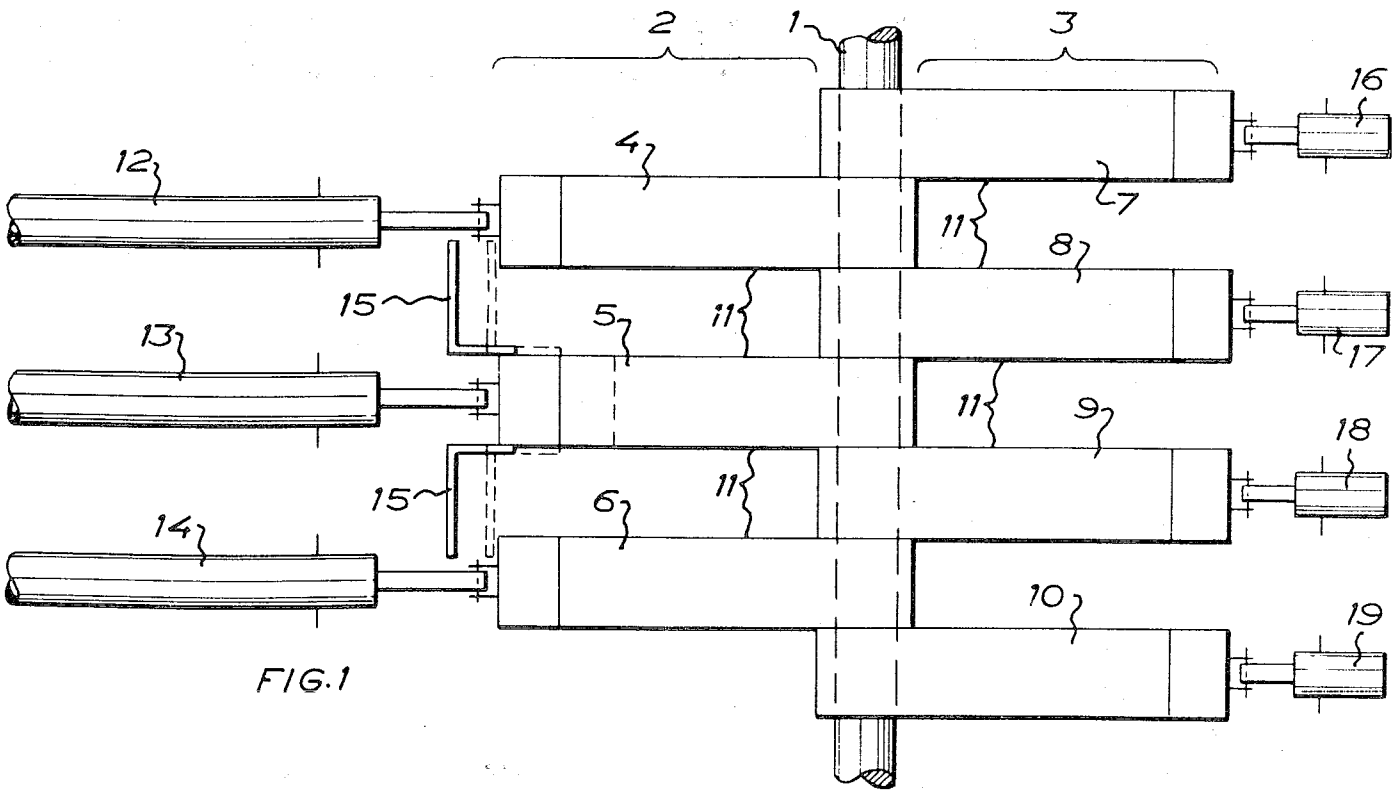
FIG. 1 schematically illustrates the general construction and localization of the jaws of cooperating jaw groups.
Figure 2:
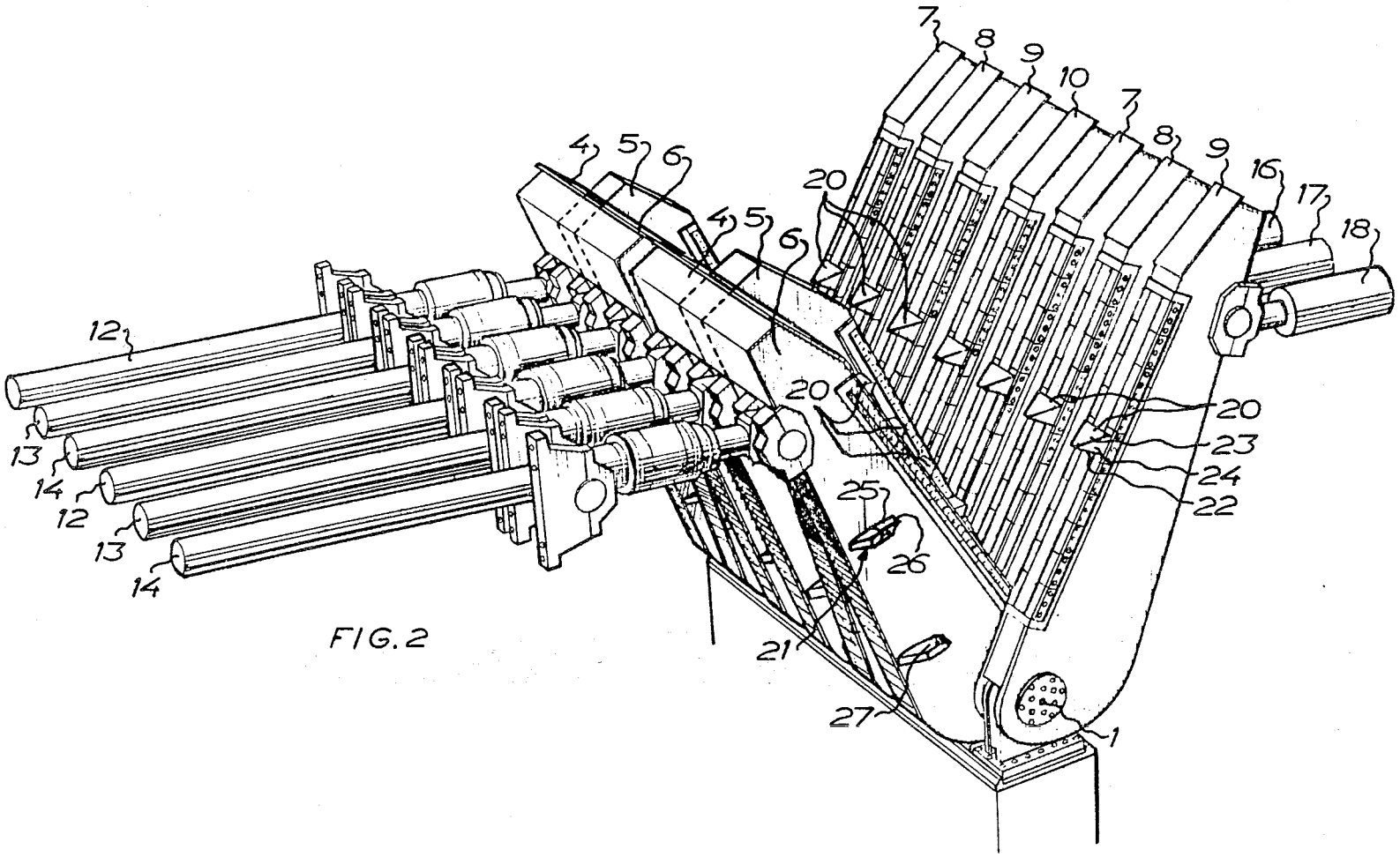
FIG. 2 is a perspective view of a jaw crusher where one group of jaws have been divided up into two parts and one jaw within either half is movable relative to the jaws positioned on either side of said one jaw.

FIG. 1, which thus is a schematical illustration of part of a jaw crusher generally designed as shown in FIG. 2, comprises, for the sake of clarity, only such details as are essential to the mode of operation.

Mounted about a fulcrum 1 are two jaw groups 2 and 3. One jaw group 2 is always movable and while the other jaw group 3 may be stationary it is movable in the embodiment shown.

The jaws 4, 5 and 6 in group 2 are arranged at an interval corresponding to the width between the jaws 7, 8, 9 and 10 in the opposite jaw group. As the jaw groups approach, the jaws, like the shanks of a pair of scissors, will overlap and produce a heavy cutting or shearing action at the sharp edge means designated by 11.

According to the invention at least one of the jaws of at least one group of jaws is movable relative to the remaining jaws of the group. In the embodiment according to FIG. 1 the jaws 4–6 in group 2 are adapted to pivot towards the jaws 7–10 in group 3. Thus, as will appear from the following, the latter group is pivotable along a shorter distance.

Consequently, it is the group 2 that effects the cutting operation proper. To achieve the intended effect the centrally situated jaw 5 is movable in forward direction, as is indicated by dash lines, from the position abreast of the other jaws.

All the jaws in group 2 are provided with driving units in the form of hydraulic cylinder-piston units 12, 13 and 14. The driving units are provided with pressure governers or like means sensing a predetermined pressure in the driving unit, i.e. it indicates when the resistance exerted by the material to be cut reaches a certain value. The sensing means are coupled to a programmable central unit which controls, in response to sensed values, the supply of power or pressure medium to the driving unit of the various jaws.

In the embodiment according to FIG. 1, and also FIG. 2, one has preferred to allow the driving unit 13 of the central jaw in the group, respectively in each half, to be primarily acted upon to entrain the side jaws 4 and 6 by mechanical entraining means 15—provided that the nature of the material to be cut does not require greater force.

If the material is easily cut up the driving unit 13 can thus by itself displace the jaws 4, 5 and 6 all the way up to the opposite jaw group 3 and during the cutting operation the central jaw 5 will travel ahead of the jaws 4 and 6 to effect a breaking or cracking action on the material in cooperation with the opposite jaws 8 and 9.

If after a certain distance of displacement the central jaw 5 encounters resistance of a certain magnitude the sensing means of the driving unit 13 will react whereby the central unit will direct power, pressure medium, also to the driving units 12 and 14 which act upon the jaws 4 and 6. These jaws can thereby be displaced forwards, abreast of and past the central jaw 5, which results in that the material to be cut will be subjected to a counterdirected cracking or breaking action.

Under the influence of the jaws 4 and 6 the material to be cut will be loosened up so that the jaw 5 can pass on in forward direction. This operation continues repeatedly whereby the material is broken and cracked in opposite directions until it is cut through.

Thus, during the cutting operation the material will be subjected to repeated cracking or breaking stresses which make it easier for the sharp edges of the jaws to tear apart the material gradually.

In the embodiment according to FIGS. 1 and 2 the jaws 7–10 in group 3 are movable along a shorter distance, as has already been mentioned. Each of the jaws is provided with a driving unit 16–19. In the embodiment shown the driving units 16–19 are coupled to a control unit which actuates the driving units in such a manner and in such a sequence that they will carry out an undulatory motion. In one embodiment this motion is primarily intended to facilitate the detachment of residues of material accumulated between the jaws after finished cutting operations. In another embodiment the driving units 16–19 are intended to be moving also during the cutting operation and in that case the undulatory or pulsating relative motion of the jaws highly contributes to facilitating the disintegration of the material. Preferably the control unit for the driving means 16–19 is connected to the central unit for the driving means 12–14 so that the movements of the jaws are adapted to the relative movement of the jaws 4–6 in such a way that a maximum breaking or cracking action is reached at every movement.

In the embodiment shown in FIG. 2 the jaw group on one side of the crusher is divided up into two halves each corresponding to the jaw group 2 of FIG. 1. For the sake of the simplicity the details in either half have been given the same reference numerals as in FIG. 1.

Figure 3:
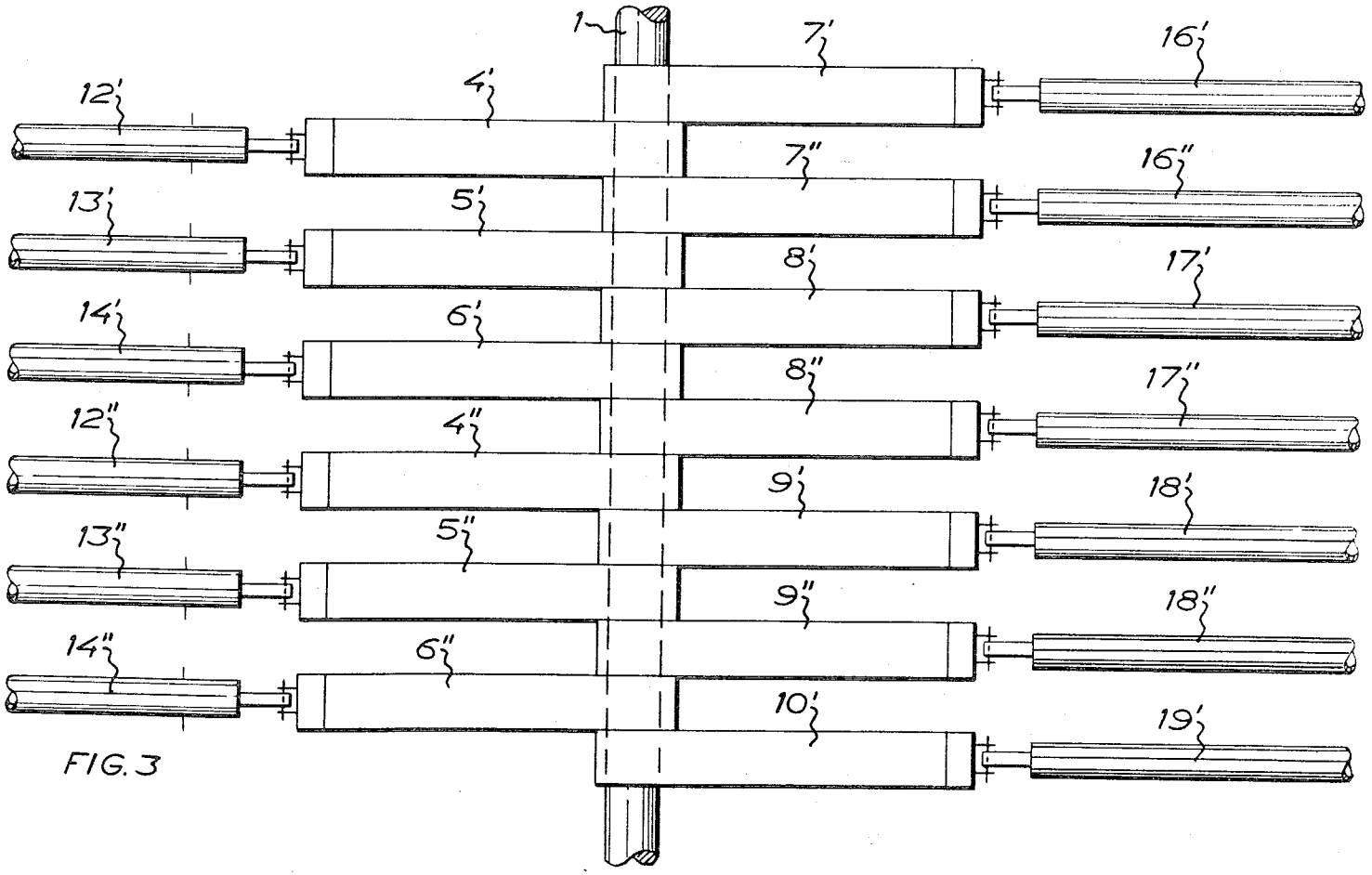
FIG. 3, like FIG. 1, is a schematical top view of a modified embodiment.

In the embodiment according to FIG. 3, which is a schematical illustration, the jaws 4', 4'', 5', 5'', 6', 6'' are pivotable relative to each other along a certain distance. The driving units 12', 12'', 13', 13'', 14', 14'' are individually actuable and, like the driving units 12–14, provided with sensing means coupled to a programmable central unit. The relative movement of the jaws is limited to the extent that no jaw can be displaced so far ahead of the adjacent jaws as to allow gaps to arise through which materail would fall down behind the jaws.

In the embodiment according to FIG. 3 the central unit is programmed so as to allow the jaws to move in accordance with the nature of the material to be cut—either manually, in that the operator selects the program, or automatically, in that the crusher in the initial stage of each cutting operation senses the resistance and the central unit decides the choice of program—in such a relationship that a maximum breaking or cracking action is obtained. The relative motion of the jaws can be adjusted relative to the resistance of the material such that jaws attacking portions of material where the resistance is heavy are allowed to carry out powerful motion relative to each other while jaws encountering more easily worked portions of material are allowed to accompany each other.

To improve the disintegration effect and to prevent to a certain extent weak long pieces of material to fall through and to prevent upward displacement of the material, the jaws of both groups, according to the embodiment shown in FIG. 2, are provided with projections 20 on the sides of the jaws facing the interior of the cutting space, and each of the flanks of the jaws are provided with laterally projecting sharp cross-edges 21. The projections 20 have an underside 22 of triangular configuration, extending tangentially to the arc of the swinging movement of the jaw, an equally triangular, downwardly inclined upper side 23 and, consequently also triangular side surfaces 24. The sharp cross-edges 21 have an upper side 25 being tangential to the same arc of swinging movement as the surface 22 of the projection 20, a transverse sharp edge 26 facing the centre of the jaw crusher and a lateral extent corresponding to half the distance between adjacent jaws. Thus the sharp cross-edges 21 of two adjacent jaws bridge the distance between the jaws and define together a sharp edge crossing the interspace.

When the jaws of both the jaw groups have moved almost completely into each other the projection 20 on the jaws of one group will pass inwardly of and over the cross-edges 21 on the sides of the cross-edges 21 of the opposite group of jaws, whereby intermediate material will be cut off.

Since the cross-edges pairwise bridge the interspace between the jaws of the two groups, said cross-edges will form a primary obstacle to material tending to fall straight through the gap between the jaws. As soon as some component of the material is stopped by the cross-edges, a build-up of material will take place preventing material from falling through when the jaw crusher is open.

The projections 20 arranged on the jaws obstruct material which during the cutting operation tends to slide upwards along the sharp edges of the jaws so that such material is retained and can be cut off.

The embodiment of FIG. 2 includes another projection, at 27, which also serves as catching means for parts of material tending to fall through the jaw crusher.

What I claim and desire to secure by Letters Patent is:

1. Jaw crusher for bulky waste and like matter, comprising two groups of jaws adapted to be movable towards and away from each other, the jaws within each group being spaced at intervals corresponding to the width of the jaws of the opposite group so that the jaws of one group as they move towards the other group travel at least partly into the interspace between the jaws of the opposite group, driving units operatively connected to at least one group of jaws to move them towards the opposite group, means to move at least one of the jaws of at least one respective group relative to the remaining jaws of the same group, said driving units comprising individually actuable driving units for individually operating each jaw of said at least one group of jaws, sensing means for sensing power exerted by said driving units, a programmable central unit operatively connected to said sensing means to be actuated thereby in response to a predetermined resistance to a jaw to actuate the driving unit of at least one adjacent jaw to change the relative position of the jaws in said group and produce a counter-directed movement of the jaws resulting in maximum breaking power.

2. A jaw crusher as claimed in claim 1, wherein one group of jaws is displaceable a distance substantially corresponding to the stroke of the crusher while the other group of jaws is displaceable along a substantially shorter distance.

3. A jaw crusher as claimed in claim 2, wherein said driving units for the opposite group of jaws comprises individually actuable driving units operably connected to a programmable control unit which controls said driving units so that the jaws of said opposite jaw group have an undulatory motion.

4. A jaw crusher as claimed in claim 1 and further comprising means for mechanically interconnecting said relatively movable jaw of one group with the adjacent jaws of the same group when the relative displacement is greater than a predetermined relative position so that said relative displacement is limited.

5. A jaw crusher as claimed in claim 1, wherein said driving units comprise cylinder-piston units and said sensing means comprises a pressure governer adapted for sensing the pressure in a cylinder-piston unit acting upon the respective jaw.

6. A jaw crusher as claimed in claim 1, wherein one jaw group comprises at least one set of jaws, each set including three jaws wherein the central jaw is displaceable relative to the jaws disposed on either side thereof.

* * * * *